United States Patent [19]

Kernick et al.

[11] 4,046,229

[45] Sept. 6, 1977

[54] ELEVATOR SYSTEM

[75] Inventors: Andress Kernick, Murrysville, Pa.; Manvel A. Geyer, Severna Park, Md.

[73] Assignee: Westinghouse Electric Corporation, Pittsburgh, Pa.

[21] Appl. No.: 640,303

[22] Filed: Dec. 12, 1975

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,589,474 | 6/1971 | Waure | 187/29 |
| 3,590,355 | 6/1971 | Davis et al. | 187/29 X |
| 3,743,055 | 7/1973 | Hoelscher et al. | 187/29 |
| 3,779,346 | 12/1973 | Winkler | 187/29 |
| 3,906,318 | 9/1975 | Kjellberg et al. | 187/29 X |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system which includes speed control apparatus which provides an error count representing the deviation of an elevator car from a desired speed versus distance reference pattern. Both the instantaneous and cumulative errors are indicated by the error count, and both are simultaneously corrected with digital precision by direct utilization of the error count. Anticipatory control of non-linear actuators responsive to the rate at which the cumulative error is corrected makes the system time optimal.

12 Claims, 15 Drawing Figures

FIG.5
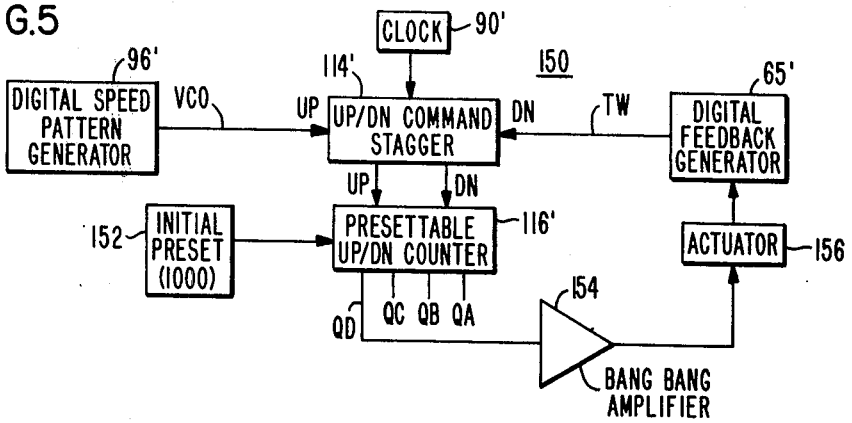
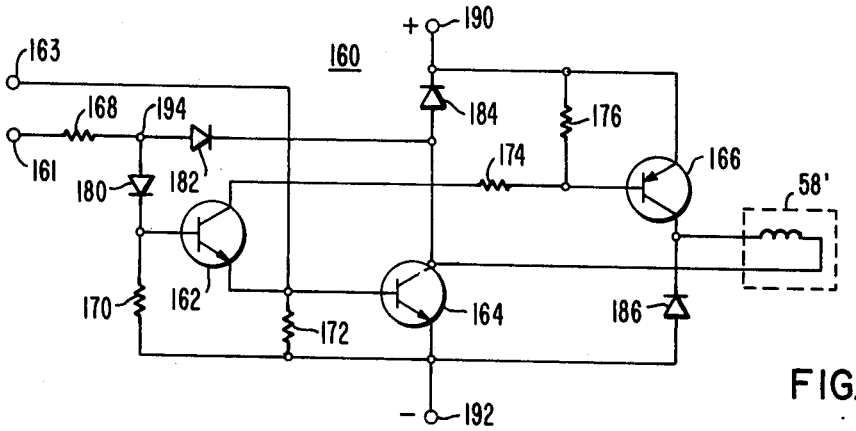
FIG.6
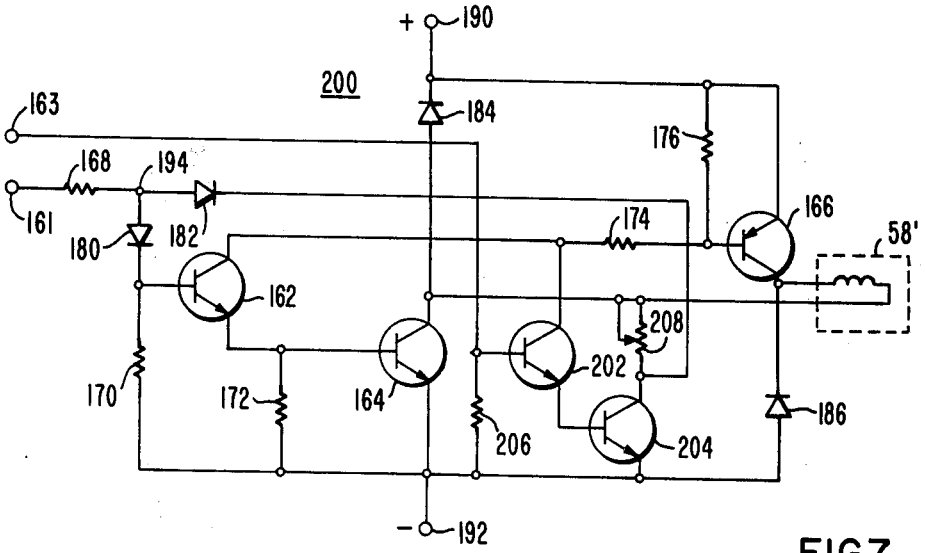
FIG.7

ELEVATOR SYSTEM

CROSS-REFERENCE TO RELATED APPLICATION

Certain of the apparatus illustrated and described in this application is claimed in a concurrently filed application Ser. No. 640,300, entitled "Elevator System", which is filed in the names of A. Kernick, M. A. Geyer, and R. J. Ravas.

BACKGROUND OF THE INVENTION

1. Field of the Invention:

The invention relates in general to elevator systems, and more specifically to stopping or landing arrangements for such systems.

2. Description of the Prior Art:

It is important in elevator systems to consistently stop an elevator car at the various floor levels of the associated structure with very little error, and to do so with an acceptable floor-to-floor time achieved within predetermined limits of acceleration, deceleration, and rates of change of acceleration and deceleration. These requirements are met by elevator systems which utilize a direct current drive motor, an adjustable source of direct current voltage, and feedback control which continuously adjusts the magnitude of the direct current voltage applied to the direct current motor to cause the elevator car to closely follow a reference speed pattern.

The initial cost of an elevator system may be reduced by using an alternating current drive motor, but the overall performance of the elevator system is below that of systems which use direct current drives, and thus the alternating current drive systems are used only at the low end of the traction elevator speed range. Because of the initial cost advantage of the alternating current elevator drive system, compared with the direct current elevator drive system, it would be desirable to improve the operation of an elevator system having an alternating current drive motor, enabling such system to be extended to higher car operating speeds without sacrificing landing accuracy, floor-to-floor time, and passenger comfort.

SUMMARY OF THE INVENTION

Briefly, the present invention is a new and improved elevator system which includes a rotating, or a linearly actuated, transducer for generating a first train of pulses responsive to actual movement of an elevator car, a pattern generator which generates a second train of pulses representing the desired movement of the elevator car with respect to a stopping point, and a counter responsive to the first and second pulse trains which keeps an accounting of the difference in the number of pulses generated in the two pulse trains. The count on the counter thus represents both the qualitative and quantitative error. A control device capable of applying first and second different deceleration efforts to the elevator car is responsive to the error count, providing the first deceleration effort when the number of pulses in the first pulse train exceeds the number in the second, and providing the second deceleration effort when the number of pulses in the second pulse train exceeds the number in the first. In the preferred embodiment, a third deceleration effort is available which overrides the first and second deceleration efforts in response to anticipatory control which is responsive to the rate the quantitative or cumulative error is corrected. The anticipatory control provides a time-optimal system response which reduces switching between the first and second deceleration efforts.

BRIEF DESCRIPTION OF THE DRAWING

The invention may be better understood, and further advantages and uses thereof more readily apparent, when considered in view of the following detailed description of exemplary embodiments, taken with the accompanying drawings, in which:

FIG. 5 is a block diagram of a bang-bang digital error feedback control system constructed according to the teachings of the invention;

FIG. 6 is a schematic diagram of an actuator amplifier which may be used for the bang-bang amplifier shown in FIG. 5, which amplifier also includes provisions for a "hang" mode;

FIG. 7 is a schematic diagram of an actuator amplifier, which is similar to the amplifier of FIG. 6, except the "hang" mode may be made indefinitely sustaining;

DESCRIPTION OF PREFERRED EMBODIMENTS

Figure 1:
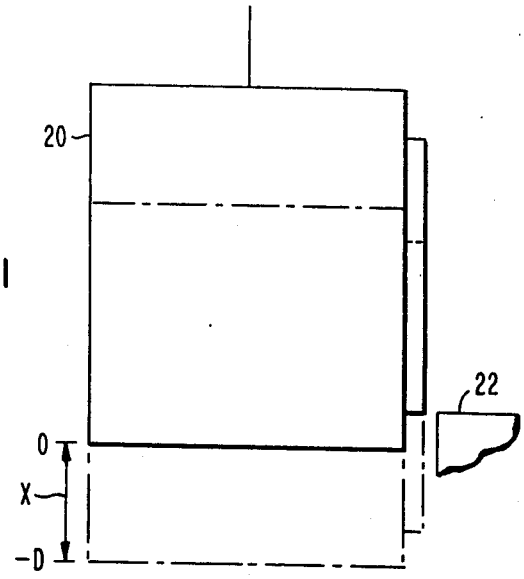
FIG. 1 is an elevational view of an elevator car which may be acurately stopped at a floor according to the teachings of the invention.

Referring now to the drawings, and to FIG. 1 in particular, there is shown an elevator car 20, with the broken line representation of the elevator car 20 illustrating the car position as it approaches a floor 22 from below, at a speed or velocity V. If the elevator car 20 is to stop at the floor 22, the ideal response would be for the car to undergo a uniform deceleration $-A$, starting at a distance −D from the final rest position, which will cause the car to stop at distance O.

The equations of motion of the elevator car are:

$$x = D + Vt + A/2\, t^2 \quad (1)$$

$$x = V + AT \quad (2)$$

$$x = A \quad (3)$$

Applying these equations to the slowdown of the elevator car 20 in FIG. 1, $x$ equals the distance traveled from D at any selected time $t$ following the initiation of slowdown at $-D$, $x$ is the velocity at any selected time $t$ following the initiation of slowdown, and $x$ is the selected constant value of deceleration $(-A)$.

Equation (2) gives the velocity $x$ as a function of time $t$, but it is important from the viewpoint of the elevator car control apparatus which must stop the car in a precise distance to known the velocity $x$ as a function of distance $x$. Solving equation (2) for time $t$ as a function of velocity $x$ gives:

$$t = \frac{\dot{x} - V}{A} \quad (4)$$

substituting (4) in (1) yields:

$$x = D - \frac{V^2}{2A} + \frac{\dot{x}^2}{2A} \quad (5)$$

and thus:

$$x = \sqrt{(V^2 - 2AD)} + 2Ax \quad (6)$$

Since $x$ approaches zero as $x$ approaches zero, and $x$ equals $V$ when $D$ (or $-D$) equals $x$, the term $(V^2\, 2AD)$ must equal zero. Thus, the velocity of the elevator car with respect to distance $x$ to go to the floor is:

$$x = \sqrt{2Ax} \quad (7)$$

Equation (7) sets forth the interrelationship of time, distance and uniform deceleration which defines the ideal compromise of passenger comfort with the proper rate of kinetic energy conversion. Equation (7) describes the parabola 21 shown in FIG. 2 in which the velocity $x$ is on the ordinate and the distance $x$ is on the abscissa. The highest or maximum car speed for the initial velocity V is Vm, which is the maximum speed of the elevator car under normal circumstances, and the distance traveled is shown as a negative abscissa $-x$.

Figure 3:
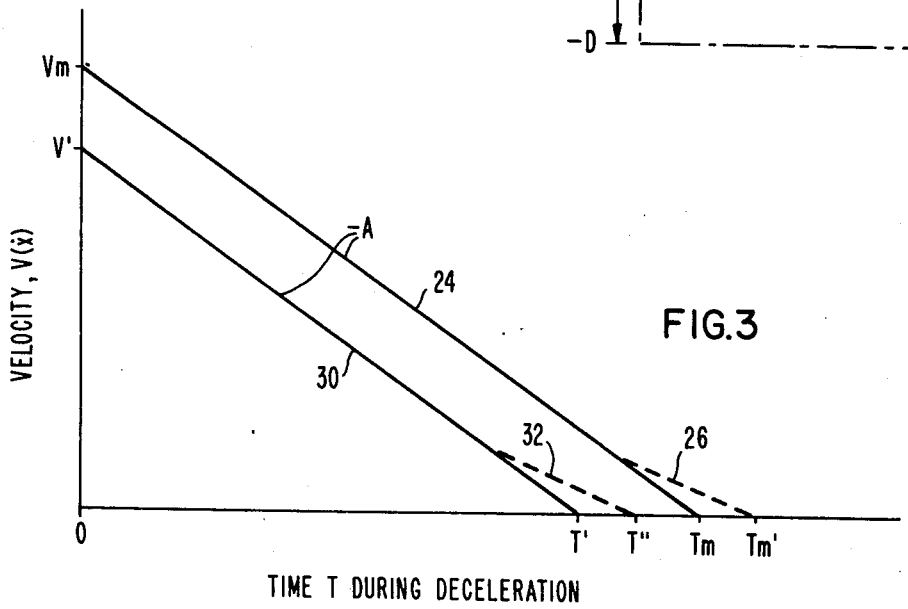
FIG. 3 is a graph which illustrates velocity versus time relationships for stopping the elevator car at a floor from different initial speeds.

Since A is a constant for uniform deceleration, the velocity $x$ versus time is a straight line, as illustrated in FIG. 3, which is a graph which plots the velocity $x$ versus time T. The deceleration of the car from the maximum velocity Vm provides a straight line 24. The broken line portion 26 represents a "flare" in the deceleration pattern which may be applied at the last instant before the elevator car stops.

Figure 2:
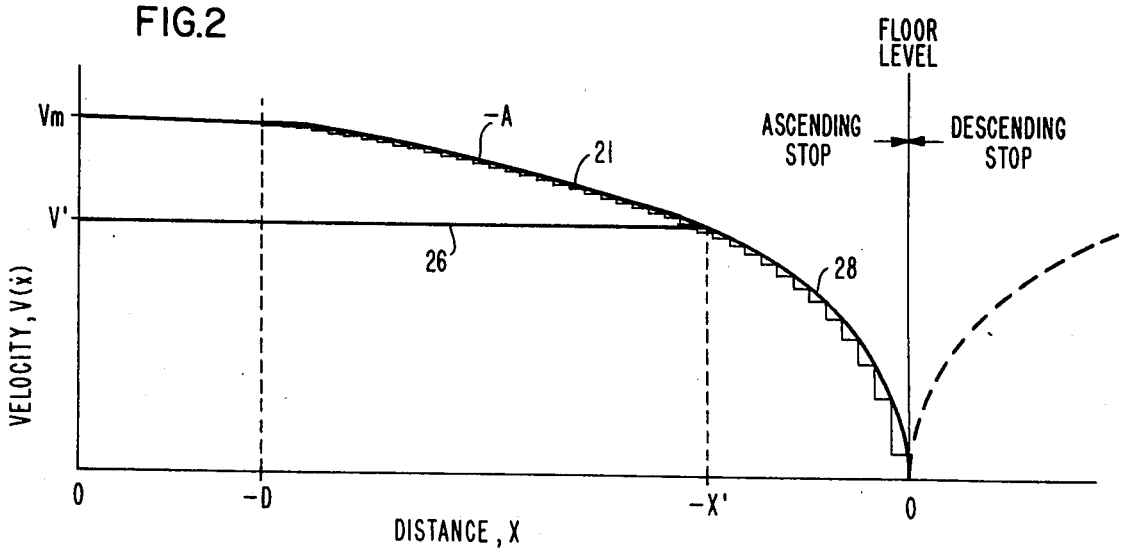
FIG. 2 is a graph which illustrates the desired velocity versus distance to the floor parabolic curve for stopping an elevator car at a floor.

The present invention selects a predetermined deceleration rate, which as a matter of passenger comfort will be −4 ft/sec², or less, and this deceleration sets the parabola or deceleration speed versus distance pattern on which the elevator car 20 is decelerated, regardless of the initial velocity of the elevator car. As illustrated in FIG. 2, if the elevator car is traveling at the maximum velocity Vm when the distance −D is reached, the control element, such as the electromechanical brake of the elevator system, is immediately actuated to initiate deceleration of the elevator car. If the initial car velocity when distance −D is reached is less than Vm, the velocity of the elevator car is not modified until the elevator car velocity and the car position match a point on the parabola 21. When this point on the parabola 21 is reached, the control element is actuated to decelerate the car along the parabola to the zero distance point, i.e., the floor level of the floor at which the car is to stop. In other words, the stopping distance is always precisely −D for all speeds, but the deceleration portion of the stopping distance depends upon the initial velocity of the car. If the initial velocity is less than Vm, such as V′, as shown in FIG. 2, then the stopping distance −D will include a first portion 26 which extends from −D to $-x'$, and a second part 28 which extends from −x′ to 0 distance. The straight line 30 in FIG. 3 defines the velocity versus time relationship during deceleration to a stop from an initial velocity of V′. The flare at the last instant before reaching zero speed is indicated by the broken line 32. The flare extends the landing time slightly from T′ to T″.

The digital control of the present invention operates to define the parabola 21 which is mathematically defined by equation (7), and all initial car speeds from Vm and below are accommodated with both passenger comfort and precise, optimal achievement of the desired stopping position.

Figure 4:
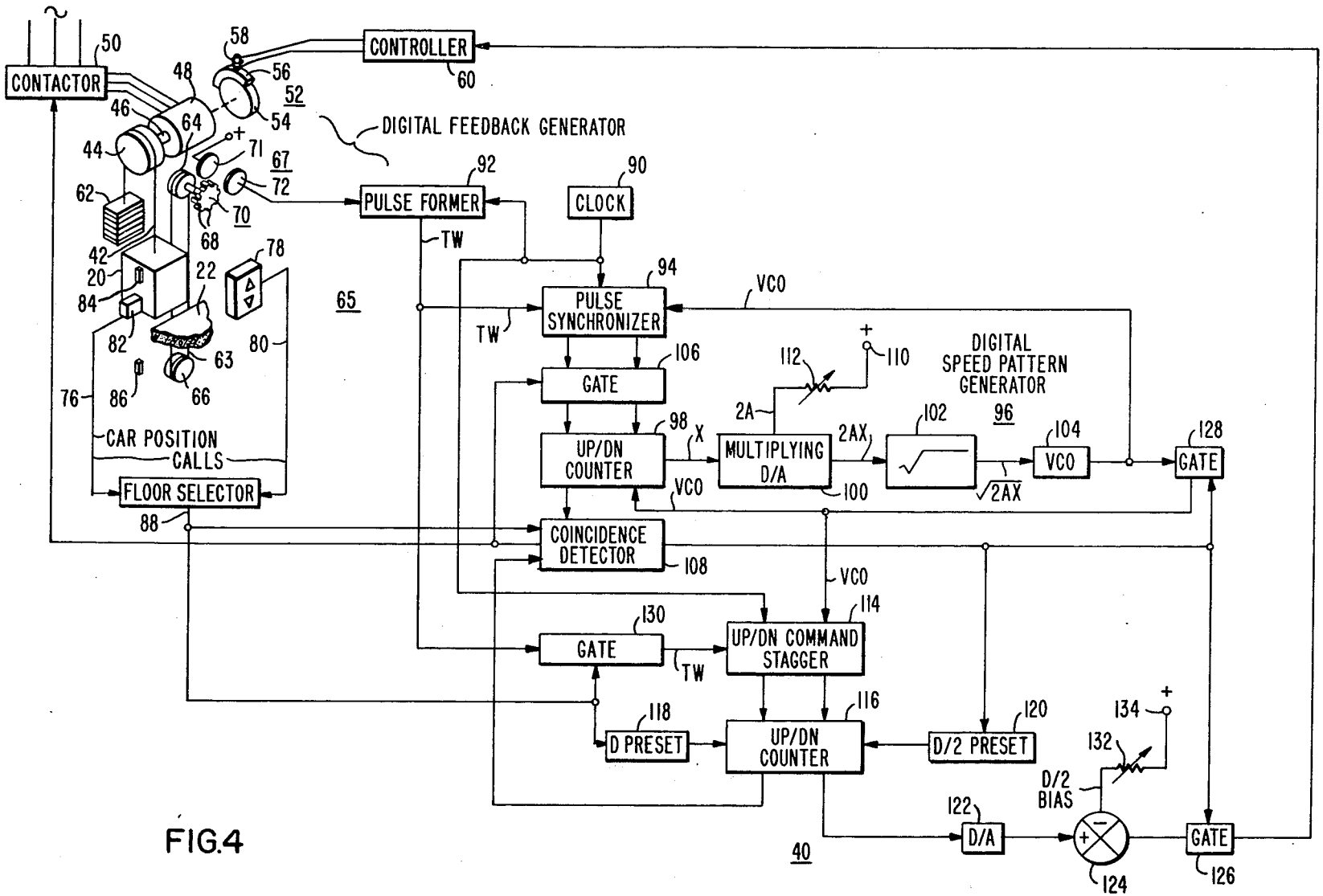
FIG. 4 is a partially schematic and partially block diagram of a new and improved elevator system constructed according to the teachings of the invention.

FIG. 4 is a partially schematic and partially block diagram of a new and improved elevator system 40 which is constructed according to the teachings of the invention. Elevator system 40 includes an elevator car 20 mounted for guided vertical movement in a building to serve the floors therein, such as floor 22. The car 20 is supported by a plurality of wire ropes, shown generally at 42, which are reeved over a traction sheave 44 mounted on the output shaft 46 of a traction elevator drive machine 48. For purposes of example, the traction elevator drive machine will be assumed to include a three-phase induction motor which is connected to a source of alternating potential via a contactor 50, and a reduction gear disposed between the induction motor and the traction sheave 44. A single speed induction motor is sufficient, but a two speed induction motor may be used in order to provide a low speed for hand operation of the elevator car during maintenance and inspection. An electromechanical brake 52 which includes a drum 54 and a brake shoe 56 which is spring applied and electrically released via a brake coil 58, is mounted to provide a retarding torque on the output shaft connected to the traction sheave 44 when the brake is applied. The brake coil 56 is energized and deenergized via a brake actuator or controller 60.

A counterweight 62 is connected to the other end of the wire rope 42. A governor rope 63, which is connected to the elevator car 20, is reeved about a governor sheave 64 at the upper end of the hoistway, and about a pulley 66 located at the bottom of the hoistway.

A digital feedback generator 65 includes a pick-up 67 disposed to detect movement of the elevator car 20 through the effect of circumferentially spaced openings or teeth 68 in a plate member 70, such as a toothed wheel, which is mounted to move with the governor sheave, such as being mounted on the shaft of the governor sheave. The openings or teeth 68 in the plate member 70 are spaced to cause the pick-up 67 to provide a pulse for each standard increment of car travel, such as a pulse for each 0.05 inch (0.127 cm) of car travel.

Pick-up 67 may be of any suitable type, such as magnetic or optical, with an optical detector having a source 71 of electromagnetic radiation and a detector 72 thereof being illustrated. Distance pulses may be developed in any other suitable manner, such as via a rotating drum; or, a linearly actuated transducer may be used, such as a tape having openings, and a detector, mounted for relative movement. The pick-up 67 provides a train of pulses which represent mechanical motion of the elevator car 20, with velocity and distance being analagous to pulse density and pulse number, respectively.

Car calls, as registered by a pushbutton array in the car 20 are directed to a floor selector 74 via conductors in a traveling cable shown generally at 76. Hall calls, as registered by pushbuttons mounted at each floor, such as pushbuttons 78, are directed to the floor selector 74 via conductors shown generally at 80.

Car position relative to a floor, such as to determine precisely when the elevator car is the distance D shown in FIG. 1 from a floor, may be determined by (a) cams and limit switches, (b) magnets and magnetically operated switches, (c) inductor relays and metallic plates, or the like. Depending upon the type of position indicator selected, a device 82 mounted on the elevator car detects when the position D is reached, indicated by indicators 84 and 86 mounted in the hoistway which detect distance D for downward and upward car travel, respectively. When distance D is detected, this indication is sent to the floor selector 74 via the traveling cable 76.

When distance D is detected and the car has a car or hall call for the floor, or it is a terminal floor, or the car is being parked at the floor, the floor selector 74 provides a signal for the digital control circuitry of the invention via a conductor, or conductors, shown generally at 88.

The digital control includes a clock oscillator 90 which has two phases of output per cycle, and a cycle rate selected to enable simultaneous actual and desired car position pulses to be separated in time. The output of clock 90 is connected to a pulse former 92 which is part of the digital feedback generator 65. Pulse former 92 receives the pulses produced by the detector 72 of the pick-up 67. The pulse former 92 provides one output pulse TW for each pulse produced by detector 72, and this output pulse is provided during a selected one of the two phases of the clock 90. If the two phases are called logic one and logic zero, for the high and low phases, respectively, it will be assumed that the pulses produced by the pulse former 92 are during the logic one phase.

The output of clock 90 is also connected to a pulse synchronizer 94 which receives the output pulses from the pulse former 92, as well as pulses VCO from a digital speed pattern generator 96 which includes an up/-down counter 98, a multiplying digital to analog converter 100, a square root device 102, and a voltage controlled oscillator 104. The voltage controlled oscillator 104 provides the feedback pulses VCO.

The pulse synchronizer 94, in response to up/down phasing from the clock 90, separates the TW and VCO pulses in time and applies the spaced TW and VCO pulses to the up and down inputs, respectively, of up/-down counter 98 via a gate 106. As will be hereinafter explained, gate 106 is controlled by a coincidence detector 108.

Before the elevator car 20 reaches the position D associated with a floor at which the car is to stop, the up/down counter 98 will be run to a binary number corresponding to the $-x'$ distance over which the car is to be decelerated for the particular velocity at which the car is proceeding. This is accomplished by the feedback loop 96 which is slaved to the TW pulse count and which provides the parabolic speed-distance characteristics shown in FIG. 2. The higher the velocity of the car, the higher the count in the up/down counter 98, and this count will automatically increase or decrease as the velocity of the car increases or decreases, respectively. The up/down counter counts up at the TW rate and down at the VCO rate, and before the car reaches point $-D$, the VCO rate follows the TW rate, but is modified by the feedback loop which operates according to equation (7).

More specifically, the count on the up/down counter 98 represents a distance $x$, and this count is multiplied by a constant which represents twice the desired rate of deceleration, or 2A. The constant 2A may be provided by a source of unidirectional potential, represented by terminal 110, which is connected to one of the multiplying inputs of the multiplying digital to analog converter 100 via an adjustable resistor 112. The setting of resistor 112 is determined by the desired deceleration rate. The output of the multiplying digital to analog converter 100 is thus equal to 2Ax, and the square root device provides a signal $\sqrt{2Ax}$ which is applied to the voltage controlled oscillator. The voltage controlled oscillator provides a train of pulses VCO at a rate responsive to the magnitude of the quantity $\sqrt{2Ax}$. Thus, referring to FIG. 2, the counter 98 contains a count when the distance $-D$ is reached which precisely defines the distance $-x'$ over which the elevator car is to be decelerated, which distance is responsive to the velocity of the car, which may be called the initial car velocity, at the precise instant that the car reaches distance $-D$.

The remaining portion of the digital control includes an up/down command stagger device 114, a second up/down counter 116, D and D/2 presets 118 and 120, respectively, for counter 116, a digital to analog converter 122, a summing circuit 124, and gates 126, 128 and 130. Coincidence detector 108, in addition to controlling gate 106, also controls gates 126 and 128, the D/2 preset 120, and the contactor 50. Gate 128 controls the application of VCO pulses from the voltage controlled oscillator 104 to a countdown input of up/down counter 98 and to an input of up/down command stagger device 114. Gate 130 controls the application of the TW pulses from the pulse former 92 to another input of up/down command stagger device 114. Clock 90 is connected to up/down command stagger device 114 to separate the TW and VCO pulses in time.

The up/down counter 116 receives the separated TW and VCO pulses from device 114 and it applies its output count to the digital to analog converter 122. The output of the digital to analog converter 122 is connected to an "add" input of the summing circuit 124. The difference between the output voltage of the digital to analog converter 122 and a constant voltage applied to a "subtract" input of the summing circuit is applied to brake controller 60 via gate 126. This constant voltage is selected by an adjustable resistor 132 connected to a source of unidirectional potential, represented by terminal 134. The controller 60 energizes the brake coil in response to the magnitude of the analog signal from the summing circuit 124. The D preset 118 is responsive to the floor selector 74, as is the coincidence detector 108, and gate 130.

The D preset sets the up/down counter 116 to a count equal to the precise distance −D shown in FIG. 2, and this preset may occur anytime up to and including the arrival of the elevator car at position −D.

When the elevator car reaches position −D and the car is to stop at the floor associated with this specific −D location, the floor selector 74 provides a signal which turns on gate 130 and directs the TW pulses to the count down input of up/down counter 116, which starts from the preset count D.

The coincidence detector 108 compares the binary count of counter 98 with the binary count of counter 116. The count of counter 98 at any instant represents the distance $-x'$ over which the car is to be decelerated along the parabolic speed/distance pattern shown in FIG. 2. If the elevator car is traveling at the maximum speed Vm at point D, the counts will be equal when the floor selector provides the stopping signal and the coincidence detector will immediately provide a coincidence signal which closes gate 106, opens contactor 50 to deenergize the AC drive motor, opens gate 128, and activates the D/2 preset 120 to preset counter 116 to a count equal to the distance D divided by two. The D/2 preset is a bias which causes the counter 116 to provide a substantial count value, even at zero error, and also provides a count value for the D/A converter which is always on the same side of zero count, regardless of whether the car is ahead of, or behind, the position which it should be occupying at any selected point in time.

The closing of gate 106 and the opening of gate 128 at coincidence initiates the ideal or desired pulse train reference representation of equation (7), and counter 98 begins stepping from a binary count of $x'$, the deceleration distance, back towards a binary count of zero.

The TW pulses responsive to actual car movement and the VCO pulses responsive to desired car movement, are applied to the count down and count up inputs, respectively, of counter 116 via the stagger device 114. This digital comparison of ideal and actual pulse trains in counter 116 provides the total cumulative error by digital integration will respect to the D/2 bias count. Gate 126 actuates the brake controller 60 by providing it with an analog error signal from the summing circuit 124. The summing circuit 124 removes the D/2 bias introduced digitally by the D/2 preset 120, to provide a true analog error signal which represents the deviation of the elevator car from the parabolic slowdown velocity versus distance pattern of FIG. 2. The brake 52 on the motor shaft responds to the analog error to maintain the desired stopping characteristics of the elevator car until the desired rest position is reached. Even one further TW pulse, from either up or down travel of the car, causes the brake to set fully after the up/down counter 98 has counted down to zero and the voltage controlled oscillator 104 has delivered its final pulse.

If the speed of the elevator car is below Vm when the distance −D is reached, the count on counter 98 will be less than the preset D count on counter 114, and gate 130 will apply the TW pulses to the countdown input of counter 116 via stagger device 114. During this period of down-counting on counter 116 towards coincidence, counter 98 is free to increase or decrease its $x'$ count responsive to car speed increases or decreases, respectively, under the direction of the pulse synchronizer which is still slaving the VCO pulses through the parabolic digital speed pattern function generator 96. This slaving ends upon coincidence of the $x'$ count in counters 98 and 116, with any variation in car velocity from −D to $-x'$ being properly followed by the voltage controlled oscillator 104 and both counters 98 and 116. When coincidence occurs, the car speed and position will be precisely on the parabolic deceleration pattern of FIG. 2 and brake actuation starts as hereinbefore described for the situation where the car is travelling at Vm, when it reaches the distance −D from floor level.

The flare deceleration shown in FIG. 3 may be easily achieved by the system shown in FIG. 4, by altering the "2A" input to converter 100 at a predetermined count on counter 98.

The elevator system of FIG. 4 converts the digital error in counter 116 to an analog signal for control of the deceleration device, i.e., the brake 52 in the FIG. 4 embodiment. Pulse train representations of information provides ample threshold against electronic "noise" and makes possible accurate, long-range signal transmission. Thus, it would be desirable to continue the digital nature of the control system completely through the actuator amplifier. Further, it would be desirable to achieve time-optimal response in such a digital system, by anticipating any transient over-shoot or under-shoot which would result from application of too much or too little corrective effort in response to error. Further, it would be desirable to combine the digital processing of the FIG. 4 concept without the use of a time lag producing signal filter, and the error signal should be produced without a digital to analog converter or a binary subtractor.

The digital error signal makes possible a superior information arrangement that presents both: (1) a precise cumulative or quantitative error accounting of the toothed wheel total that must balance the number of pulses D in the digital reference, which fixes distance to the floor exactly, and (2) an accurate qualitative indication of velocity error in the form of difference in pulse spacing so that uniform deceleration of an elevator car may be maintained right to the desired landing position. This digital approach makes possible control of a brake which is non-linear with respect to speed, temperature and age.

FIG. 5 is a block diagram of a bang-bang digital error feedback control system 150, which may be similar to the system shown in FIG. 4 up through the presettable up/down counter 116. Apparatus in FIG. 5 which may be similar to items already described in FIG. 4 will be given the same reference numerals as in FIG. 4 with a prime mark, and will not be described again in detail.

In the system 150, the counter 116' is preset to binary address 1000 by suitable preset apparatus shown in block from at 152. The logic one on $Q_D$, the most significant bit (MSB) of its output count causes a bang-bang amplifier 154 to provide maximum system drive to an actuator 156, which may include the brake coil 58, for example, shown in FIG. 4. With full drive applied to the actuator 156, minimum braking effort is provided and the rate of the feedback pulse train TW will soon exceed the rate of the reference pulse train VCO. Counter 116' will then be corrected to a binary address 0111 when the most significant bit $Q_D$ becomes zero, and the maximum system drive is reduced to zero which applies the braking torque to the motor drive shaft. A limit cycle is sought in which the counter 116' switches back and forth between output addresses or counts 1000 and 0111. Anticipatory control, to be hereinafter described, promotes the existence of such a limit cycle.

The counter 116' has a storage capacity for cumulative or quantitative error, as well as qualitative error, which is important in elevator control, as both errors are to be minimized. The present invention controls the rate at which the cumulative error, either positive or negative, is corrected, and FIG. 6 illustrates an actuator amplifier or inverter 160 which may be used for the bang-bang amplifier 154 shown in FIG. 5. Amplifier 160 may also be used to promote a mode intermediate to full-on and full-off, which will be termed a "bang-hang" mode. Amplifier 160 includes first and second input terminals 161 and 163, respectively. If only a bang-bang mode is desired, input terminal 161 would be connected to the $Q_D$ output of counter 116', and input terminal 163 would be unused. The output of amplifier 160 is connected to the actuator, which may be a brake coil 58', similar to the brake coil 58 shown in FIG. 4.

Amplifier 160 includes first, second and third junction transistors 162, 164 and 166, with transistors 162 and 164 being of the NPN type, and transistor 166 being of the PNP type.

Amplifier 160 further includes resistors 168, 170, 172, 174 and 176, rectifier diodes 180, 182, 184 and 186, and sources of positive and negative potential, represented by terminals 190 and 192, respectively. Input terminal 161 is connected to the base of transistor 162 via resistor 168 and diode 180, with diode 180 being poled to conduct current into the base. The junction 194 between resistor 168 and diode 180 is connected to positive terminal 190 via diodes 182 and 184, each poled to conduct current from junction 194 to terminal 190. The base of transistor 162 is connected to negative terminal 192 via resistor 170, its emitter is directly connected to the base of transistor 164, and to input terminal 163, and via resistor 172 to the negative terminal 192. Its collector is connected to the base of transistor 166 via resistor 174, and the base of transistor 166 is also connected to the positive terminal 190 via resistor 176. The emitter of transistor 166 is connected to the positive terminal 190, and its collector is connected to negative terminal 192 via diode 186, which is poled to conduct current from terminal 192 to the collector. Transistor 164 has its collector connected to positive terminal 190 via diode 184, and its emitter is connected to negative terminal 192. The brake coil 58' is connected to the collectors of transistors 164 and 166.

In the operation of amplifier 160 in a bang-bang mode, a logic one input to terminal 161 from the QD output of counter 116' saturates all three transistors to provide maximum plus-to-minus drive to the brake coil from positive terminal 190, the emitter-collector path of transistor 166, brake coil 58', and the collector-emitter path of transistor 164. When the QD output changes to a logic zero, all three transistors are turned off to cause the brake coil 58 to rapidly discharge its stored energy through diodes 186 and 184 at full negative to positive voltage.

As will be hereinafter explained, a third mode, which will be called a "hang" mode, may be provided by applying a logic one to input terminal 163 when input terminal 161 goes to logic zero. This will keep transistor 164 conductive and provide a commutation path through transistor 164 and diode 186. This commutation path allows the energy stored in the field of the brake coil 58' to dissipate more gradually through its own internal resistance. A bang-bang feedback control system would use only the first two modes, while a bang-bang feedback control system would use all three modes.

FIG. 7 is a circuit diagram of an actuator amplifier 200 which is similar to amplifier 160 shown in FIG. 6, except the third operating mode is made indefinitely sustaining. In the FIG. 6 embodiment, a logic one signal applied to input terminal 161 overrides a logic one applied to input terminal 163. In the FIG. 7 embodiment, a logic one applied to input terminal 163 overrides control by terminal 161. Like reference numerals in FIGS. 6 and 7 indicate like components and functions.

In FIG. 7, NPN junction transistors 202 and 204 have been added, along with a resistor 206 and an adjustable resistor 208. Control by terminal 163 has been transferred from transistor 164 to transistor 202. Terminal 163 is connected to the base of transistor 202 and to negative terminal 192 via resistor 206. The collector of transistor 202 is connected to the collector of transistor 162, and its emitter is connected to the base of transistor 204. The emitter of transistor 204 is connected to negative terminal 192, and its collector is connected to the collector of transistor 164 via adjustable resistor 208. The cathode of diode 182 is connected to the collector of transistor 204, instead of to the collector of transistor 164. In the FIG. 7 embodiment, a logic one at input terminal 163 causes transistors 202 and 204 to be conductive, providing a "sustained hang" current path through the coil 58', resistor 208, transistor 204 and diode 186. When transistors 202 and 204 are conductive, transistors 162, 164 and 166 cannot become conductive, regardless of the signal applied to input terminal 161.

The objective of the "hang", and "sustained hang" modes of operation, shown in FIG. 6 and 7, respectively, is to (*a*) reduce the switching rate of the actuator amplifier, which in certain applications will also result in a significant decrease in power dissipation, and (*b*) increase the propensity of the system to dwell at zero error. The management of these three qualitative states of digital error so that dead band and anticipatory control may be utilized in a manner such that the digital feedback control becomes time optimal, will now be described.

Assume that a large cumulative error excursion on counter 116' of FIG. 5 has occurred, either up or down from binary 1000 to 0111 interface of zero error, due to some step change imposed upon the system. Cumulative error is stored in counter 116' in the form of a binary counting of error pulses to an extent away from the binary 1000 to 0111 interface. This cumulative error is corrected only when the VCO and TW pulse totals are brought back into balance. A return swing of a non-anticipatory feedback control system, in reestablishing VCO and TW pulse balance, under the influence of full "bang" drive capability will result in an appreciable over-shooting of the common zero error state for both cumulative and qualitative error. An excess transient is avoided if some anticipatory control is used to reverse the drive at a proper instant before the zero error interface is reached. A criterion by which the anticipatory instant can be determined is from the bit rate of change in counter 116' relative to time, to bit difference from address 1000, and to some consideration of the actuator response.

Figure 8:
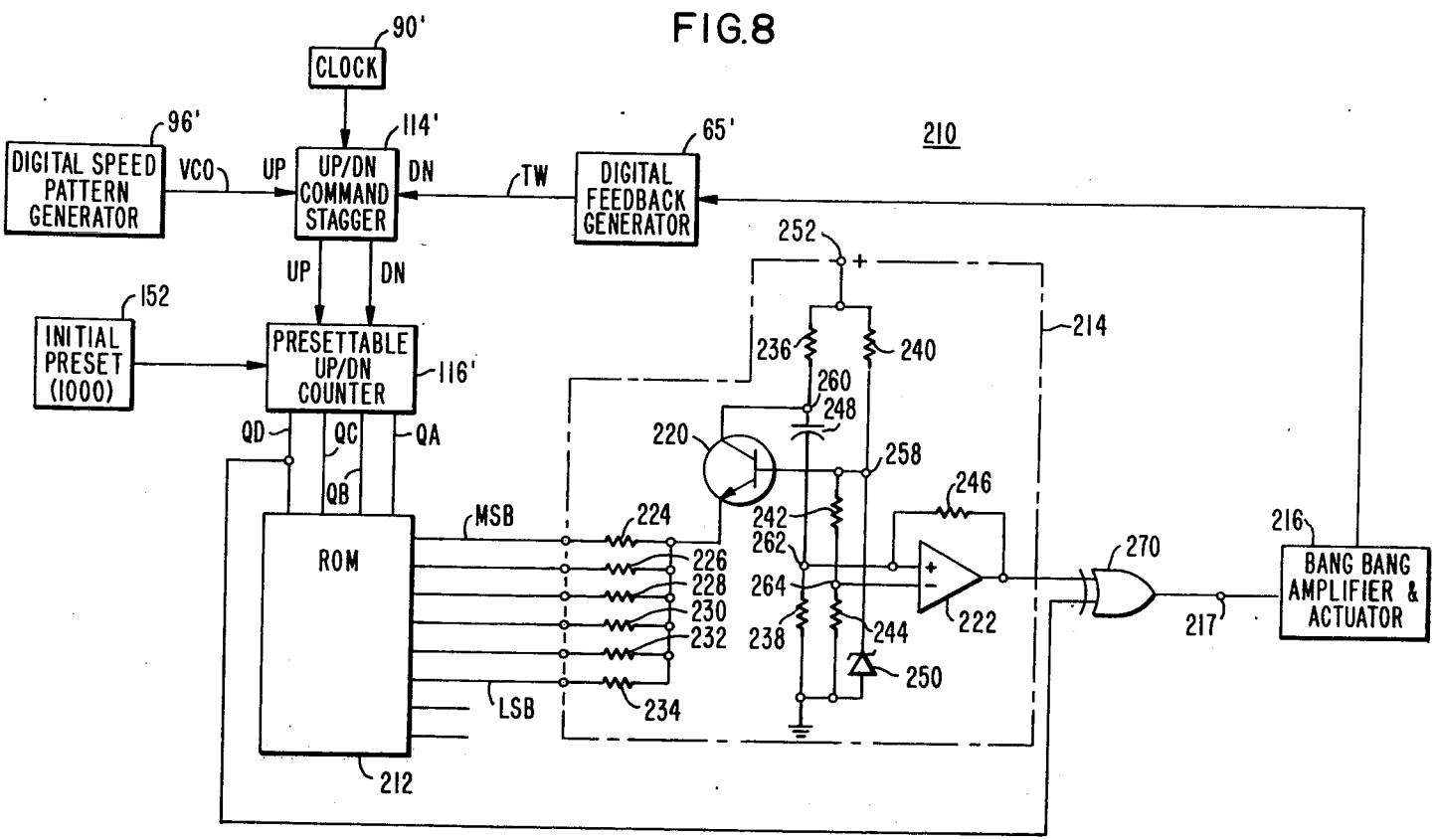
FIG. 8 is a schematic diagram of a digital error feedback control system constructed according to another embodiment of the invention, which embodiment includes an anticipatory feature.

FIG. 8 is a schematic diagram of a digital error feedback control system 210, which adds an anticipation feature, including a read-only memory 212, an anticipatory circuit 214, and a bang-bang amplifier and actuator 216, to the system 150 shown in FIG. 5. The bang-bang amplifier and actuator 216 may be the amplifier 160 and brake coil 58 shown in FIG. 6, with its input terminal 217 corresponding to input 161 of amplifier 160. Like reference numerals in FIGS. 5 and 8 refer to like components. The read-only memory 212, which may be an Intersil IM 5600C, provides six bit binary output words in response to binary input addresses at, above, and below the 1000-0111 neutral interface. The binary addresses are provided by using the $Q_A$, $Q_B$, $Q_C$ and $Q_D$ outputs of counter 116'.

The anticipatory circuit 214 includes an NPN junction transistor 220, a comparator 222, such as an operational amplifier, resistors 224, 226, 228, 230, 232, 234, 236, 238, 240, 242, 244 and 246, a capacitor 248, a Zener diode 250, and a source of positive potential, represented by terminal 252. Resistor 224 is connected to the output of read-only memory 212 which represents the most significant bit (MSB), and resistors 226, 228, 230, 232 and 234 are connected to inputs of read-only memory 212 which represent increasingly lower bit positions, such that resistor 234 is connected to the least significant bit (LSB) utilized. The remaining ends of resistors 224, 226, 228, 230, 232 and 234 are connected to the emitter of transistor 220.

Resistor 236, capacitor 248 and resistor 238 are serially connected, in the recited order, from positive terminal 252 to ground. In like manner, resistors 240, 242 and 244 are serially connected from positive terminal 252 to ground. Zener diode 250 is connected across the serially connected resistors 242 and 244, with its anode being connected to ground and its cathode connected to junction 258. The collector of transistor 220 is connected to the junction 260 between resistor 236 and capacitor 248, and its base is connected to junction 258.

The non-inverting input of comparator 222 is connected to the junction 262 between capacitor 248 and resistor 238, and its inverting input is connected to the junction 264 between resistors 242 and 244. Resistor 246 is a feedback resistor connected between the output of comparator 222 and its non-inverting input.

System 210 also includes an exclusive OR 270 which has one of its inputs connected to the output of comparator 222, and its other input connected to output $Q_D$ of counter 116'. The output of the exclusive OR 270 is connected to input terminal 217 of the bang-bang amplifier and actuator.

Figure 9:
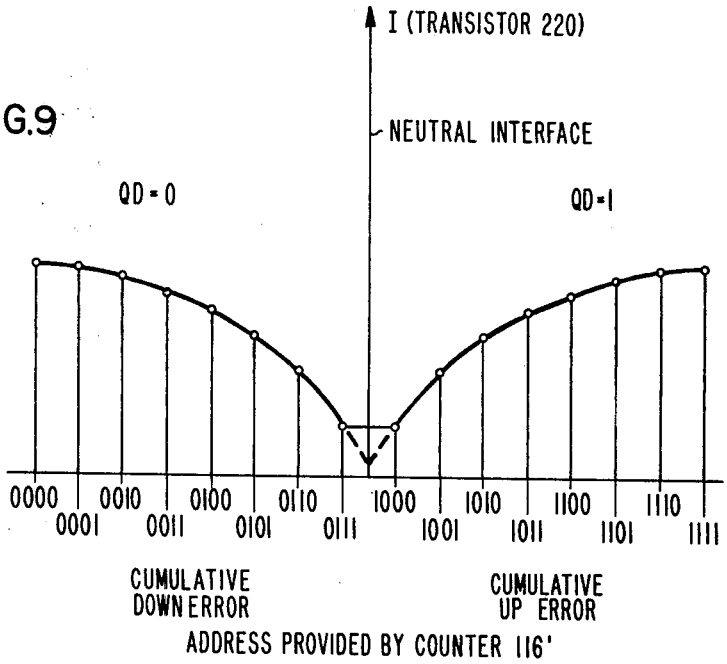
FIG. 9 is a graph which is explanatory of the anticipatory feature of FIG. 8.

The read-only memory 212 is programmed to provide a selected binary output for each address provided by counter 116'. Each read-only memory output selects a resistor, or combination of resistors, connected to the emitter of transistor 220, which will result in a current flow through transistor 220 having a magnitude responsive to the magnitude of the error represented by the count or read-only memory address provided by counter 116'. The greater the cumulative up or down error between the TW and VCO counts, the greater the current flow through transistor 220. FIG. 9 is a graph which plots current flow through transistor 220 versus the output count or address provided by counter 116'. The current curve in FIG. 9 clearly illustrates the minimum transistor current at the neutral interface, between the logic zero and logic one states of output $Q_D$ of counter 116', and the increasing transistor current as the magnitude of the error increases in either direction from this interface.

As the cumulative error increases in either direction, comparator 222 is held off by the negative potential at junction 262, which is produced by current flow from the capacitor 248 to the collector of transistor 220, as well as from an inverting reference potential at junction 264. When comparator 222 is held off, the logic zero applied to the associated input of the exclusive OR 270 causes the exclusive OR to pass the "zero" or "one" "bang-bang" commands from $Q_D$ to the bang-bang amplifier and actuator.

As cumulative error from either direction is corrected toward the neutral interface, the current in transistor 220 decreases in a programmed manner, as illustrated in FIG. 9. Junction 262 is then positive by a time dependent amount responsive to the rate of recharge of capacitor 248. If the charge rate of capacitor 248 is great enough, comparator 222 will find junction 262 momentarily exceeding the reference potential at junction 264 and comparator 222 will apply a logic one to the exclusive OR 270. This logic one output of comparator 222 thus indicates a rapid return toward the neutral interface which requires anticipatory snubbing in order to prevent excessive overshoot. Even though $Q_D$ is still indicating an up error, for example, the logic one $Q_D$ command is altered by the anticipatory circuit 214 to a logic zero command which thus switches the bang-bang amplifier earlier than it normally would. In like manner, if $Q_D$ is indicating a down error, when comparator 222 provides a logic one output, the $Q_D$ output of logic zero will be switched by the exclusive OR to a logic one, to switch the bang-bang amplifier earlier than $Q_D$ would normally switch it. This override of $Q_D$ by the anticipatory ladder network 214 provides time optimal response, causing the feedback control to return optimally to the vicinity of the neutral interface and find its limit cycle.

Figure 10:
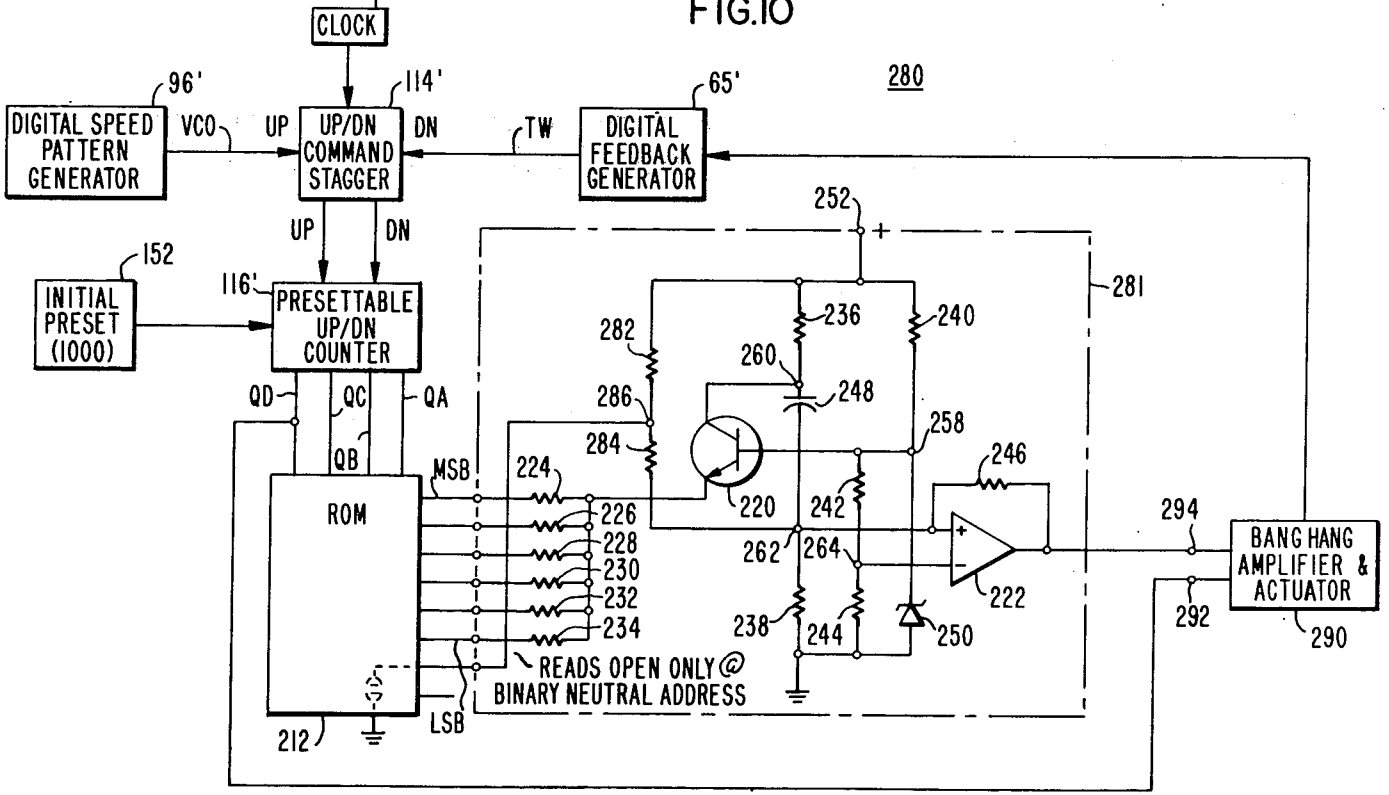
FIG. 10 is a schematic diagram of a digital error feedback control system which may use either of the amplifiers shown in FIGS. 6 and 7, as well as the anticipatory "hang" features available in these amplifiers.

FIG. 8 provides time optimal override of bang-bang signals, and does not use the anticipatory "hang" mode available in the amplifiers shown in FIGS. 6 and 7. FIG. 10 is a schematic diagram of a digital error feedback control system 280 which may utilize the "hang" mode, and thus may use either of the amplifiers shown in FIGS. 6 and 7. Like reference numerals in FIGS. 8 and 10 indicate like components.

Control system 280 includes an anticipatory ladder network 281, which is similar to the anticipatory ladder network 214 shown in FIG. 8, except for the addition of resistors 282 and 284 which are serially connected from positive terminal 252 to junction 262. The junction 286 between these two resistors is connected to an unused output of read-only memory 212, which output bit is programmed to read "open" only at the binary neutral address, i.e., at zero error, and to otherwise effectively connect junction 286 to ground. The output of comparator 222 is connected to an input terminal 294 of amplifier 290, which terminal represents input terminal 163 of the amplifier shown in either FIG. 6 or 7, and output $Q_D$ of counter 116' is connected to input terminal 292 of amplifier 290, which input terminal represents input terminal 161 of the amplifier shown in either FIG. 6 or 7.

Figure 11:
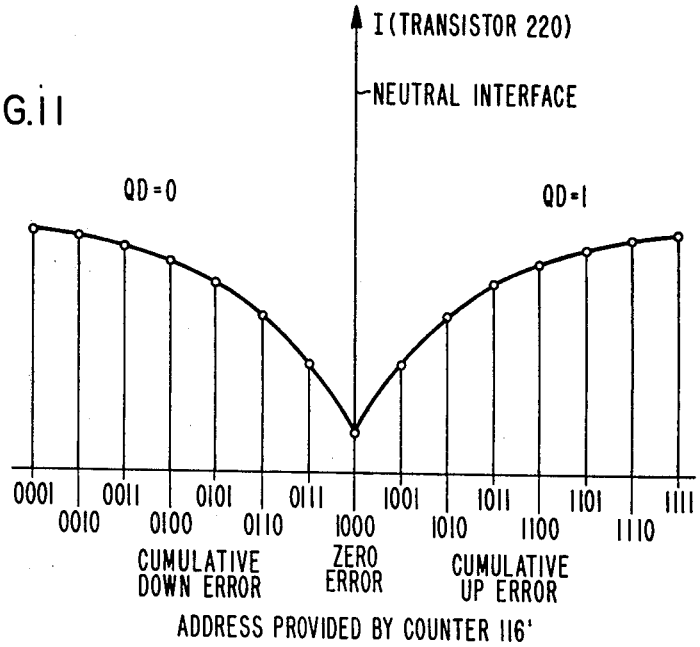
FIG. 11 is a graph which is explanatory of the operation of the system shown in FIG. 10.

In the system of FIG. 10, a neutral address of counter 116' is chosen, such as binary 1000, so that the "hang" operational mode prevails over either a one or a zero from $Q_D$. The read-only memory 212 is programmed to provide minimum current at only the address 1000, as illustrated in the graph of FIG. 11, instead of at both values 0111 and 1000 on each side of the neutral interface, as illustrated in the graph of FIG. 9.

In the operation of the digital feedback control system 280, anticipatory relaxation of drive is to the neutral address 1000 which produces the "hang" mode, rather than to an opposite polarity "bang". When the anticipatory ladder network 281 anticipates an overshoot and provides a logic one at the output of comparator 222 to input terminal 294, the resulting hang mode should dissipate the energy stored in the brake coil such that the zero error occurs with final dissipation of the coil energy. The hang position will then be maintained as long as zero error is maintained by the voltage applied to junction 262 which maintains junction 262 above the potential of junction 264. If the hang mode causes the decreasing error to cross over the neutral address, instead of stopping at it, the opposite polarity "bang" drive will encounter no inhibit from the anticipatory ladder network 281 because the rate of change of current in transistor 220 goes from decreasing to increasing and the junction 286 will be connected to ground at all addresses except zero error.

Figure 12A:
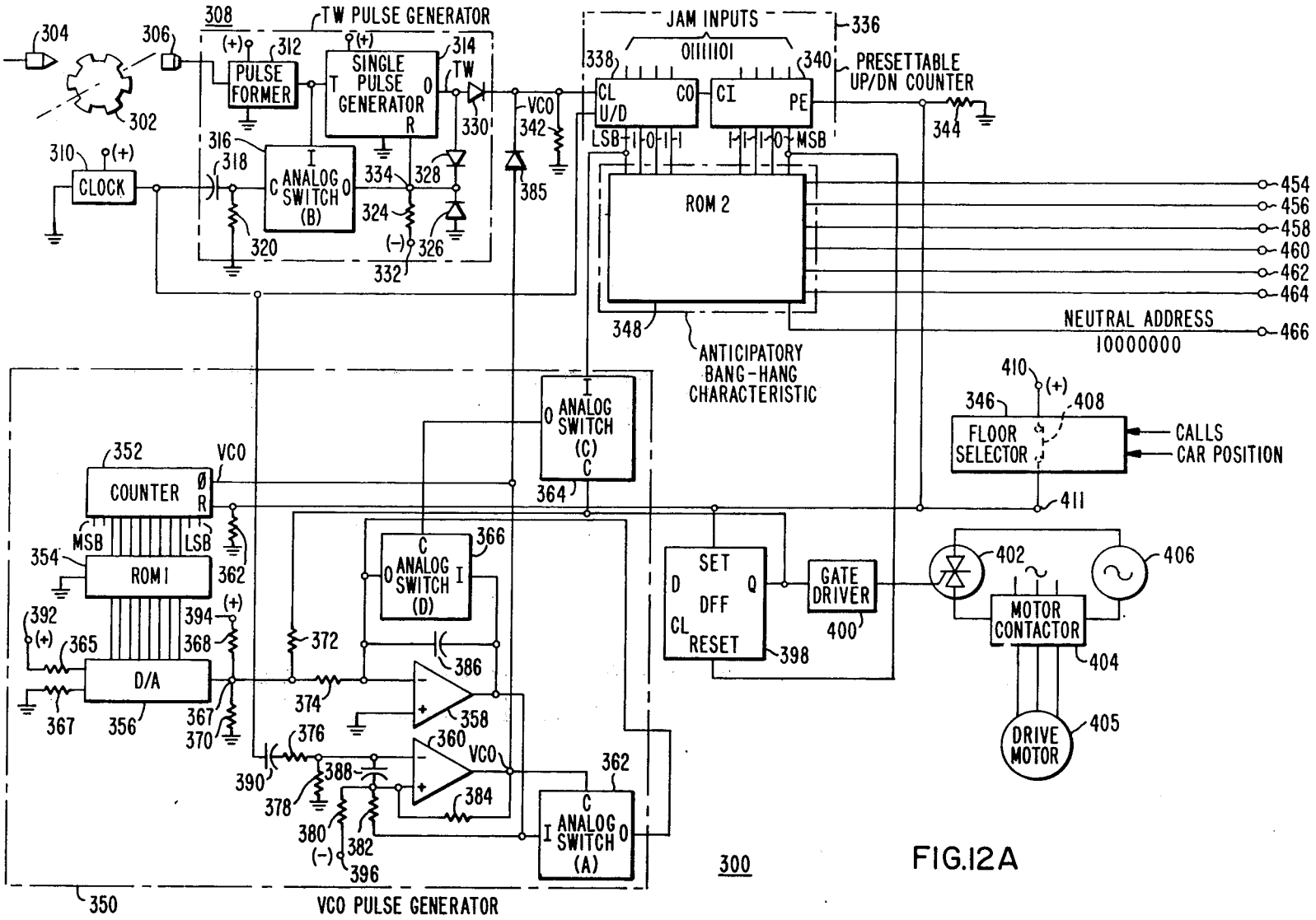
FIGS. 12A and 12B are schematic diagrams which may be assembled to provide a new and improved elevator system which includes a digital feedback control system for operating a deceleration control element of the elevator system.
Figure 12B:
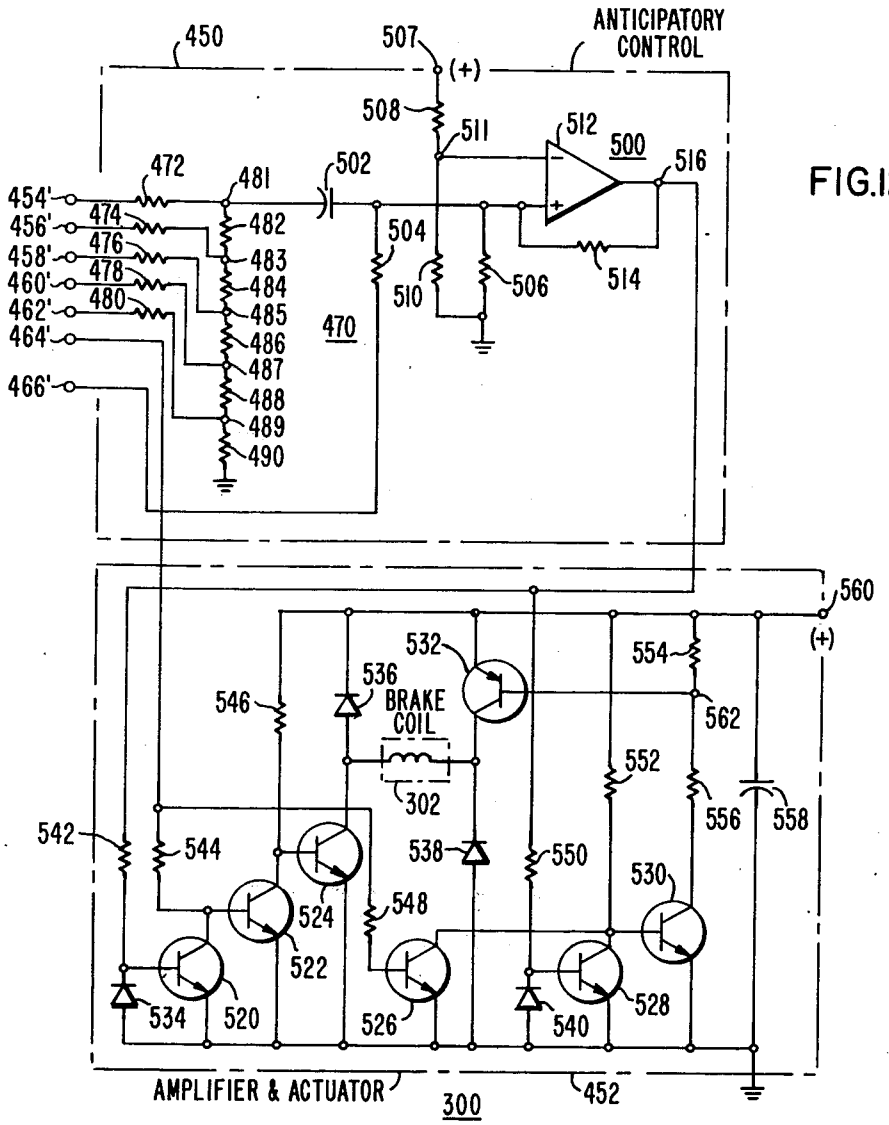
Figure 13:
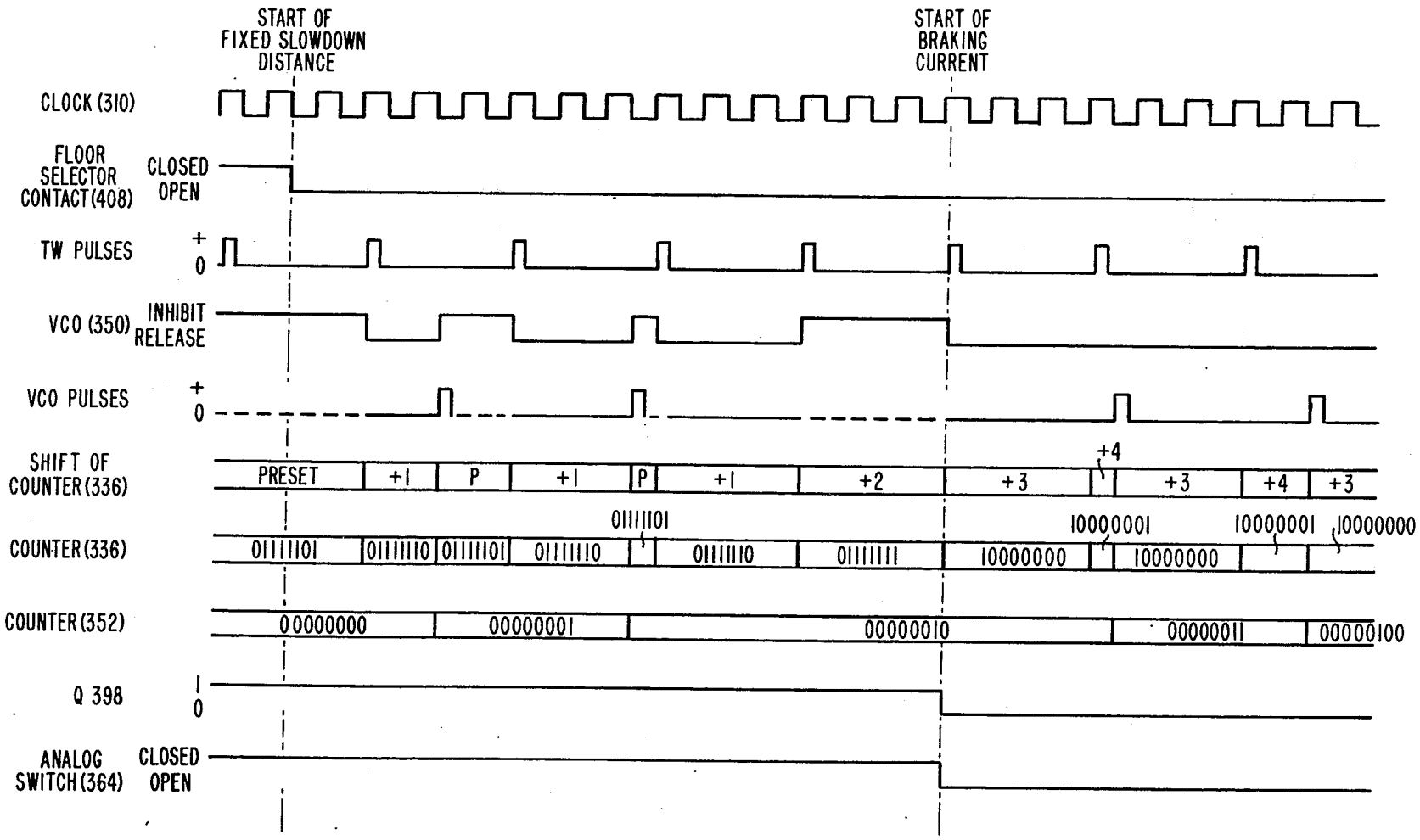
FIG. 13 is a graph which will aid the understanding of the operation of the elevator system shown in FIGS. 12A and 12B.

FIGS. 12A and 12B are schematic diagrams which may be assembled to provide a new and improved elevator system 300 which includes a digital feedback control system for operating a deceleration control element of the elevator system, such as the brake coil 302 of an electromechanical friction brake. FIG. 13 is a graph which will aid in understanding the operation of the system 300, and it will be referred to when appropriate while describing FIGS. 12A and 12B. The embodiment of the invention shown in FIGS. 12A and 12B introduces some alternative arrangements for performing certain of the functions of a digital feedback control system, which functions have been hereinbefore described relative to FIGS. 4, 6, 7, 8 and 10.

Elevator system 300 includes means for developing pulses TW in response to movement of the elevator car, such as in response to a toothed wheel 302, a source 304 of electromagnetic radiation, a detector 306 of such electromagnetic radiation, and a pulse generator 308. The source 304 and detector 306 are disposed relative to the toothed wheel 302 such that a pulse is produced for each standard increment of elevator car movement, such as 0.05 inch. The coupling of the toothed wheel 302 to the elevator car may be the same as illustrated in FIG. 4, and thus the elevator car is not illustrated in FIGS. 12A and 12B. The pulse generator 308 provides a single pulse TW within a predetermined time slot for each pulse provided by detector 306, which time slot is spaced from time slots in which the pattern or reference pulses may appear. The reference or speed pattern pulses are termed VCO pulses as in the other embodiments. A clock 310 provides signals for properly synchronizing the TW and VCO pulses.

The TW pulse generator 308 includes a pulse former 312, such as the HEI Inc. model OS-591S-XXXL, a single pulse generator 314, such as Signetic's timer NE 555, connected as a one-shot, an analog switch 316, such as one of the four switches included in RCA's CD 4016, a capacitor 318, resistors 320 and 324, and rectifier diodes 326, 328 and 330. The clock 310, which may be an 18 Khz. clock, for example, provides a waveform as illustrated in FIG. 13 adjacent the heading "clock 310". For purposes of example, the high or logic one portion of the clock cycle will be used to synchronize the TW pulses, while the low or logic zero portion of the clock cycle will be used to synchronize the VCO pulses. The clock 310 turns on switch 316 at the 18 Khz. rate via the RC circuit which includes capacitor 318 and resistor 320. When a pulse is produced by the pulse former 312, it is gated through switch 316 during a logic one of the clock output. The output of switch 316 is connected to the reset input R of the single pulse generator 314 such that the pulse from the pulse former must first reset the single pulse generator 314, enabling the same pulse which is applied to the trigger input T from the pulse former 312 to then initiate a timed output pulse TW.

Resistor 324 has one side connected to a negative source of potential, indicated by terminal 332, and its other side is connected to the output of switch 316 at junction 334. Diode 326 has its cathode connected to junction 334 and its anode is connected to logic common, which will be referred to as ground. Diode 328 has its anode connected to the output 0 of single pulse generator 314, and its cathode is connected to junction 334. This arrangement causes the leading edge of pulse TW to lag the leading edge of the associated clock pulse, as illustrated in FIG. 13, due to delayed recovery of diode 326. Thus, the same clock pulse may be used to set a presettable up/down counter 336 for up counting before the TW pulse is applied to the counter 336 via the diode 330, which is poled to conduct current to the counter 336. The timing of the one shot pulse is selected to terminate the TW pulse before the termination of the associated clock pulse, also as indicated in FIG. 13. Counter 336 may include first and second four stage binary counters 338 and 340, respectively, with the TW pulse being applied across a resistor 342 to the clock input CL of counter 338, and with the clock 310 being connected to the up/down input U/D. A high signal applied to the U/D input sets the counter to count up, while a low signal sets it to count down. The carry out output CO of counter 338 is connected to the carry in input CI of counter 340, and the preset enable input PE is connected to ground via a resistor 344. The JAM inputs of the two counters are connected to a preset device to provide the JAM inputs of counter 338 with the binary address 0111 and the JAM inputs of counter 340 with the binary address 1101. The four outputs of each of the counters 338 and 340 are connected to a read-only memory 348, such as INTEL's 1302, which will be referred to as ROM 2. ROM 2 is programmed with a desired anticipatory bang-hang characteristic, such as illustrated graphically in FIG. 11.

The elevator system 300 also includes a voltage controlled oscillator pulse generator 350, which provides a train of reference pulses VCO responsive to the desired movement of the elevator car. The VCO pulse generator 350 includes a 12 stage ripple-carry binary counter 352, such as RCA's CD 4040 AE; a read-only memory 354, which will be referred to as ROM 1, which is programmed with the desired parabolic deceleration program such as illustrated graphically in FIG. 2; an 8 bit digital to analog converter 356, such as Motorola's MC 1508L8; first and second operational amplifiers 358 and 360, such as Texas Instrument's dual operation amplifier SN 72747; first, second and third analog switches 362, 364 and 366, respectively, which may be the remaining three analog switches of RCA's CD 4016; resistors 365, 367, 368, 370, 372, 374, 376, 378, 380, 382 and 384; capacitors 386, 388 and 390; a source of positive potential represented by terminals 392 and 394; and, a source of negative potential represented by terminal 396.

The elevator drive motor, indicated generally at 405, includes a contactor 404 having an AC coil connected to a source 406 of alternating potential via a triac 402. Triac 402 is controlled by a gate driver 400, which in turn is responsive to a motor start/stop memory, which may be a D-type flip-flop 398, such as 1/2 of RCA's dual D-type flip-flop CD 4013. When the Q output of flip-flop 398 is high, the gate driver 400 provides firing pulses for the triac 402 and the motor contactor picks up to energize the elevator drive motor. When the Q output goes low, the gate driver ceases to fire the triac, the contactor 404 drops out, and the elevator drive motor is deenergized.

A floor selector 346, which is responsive to car position and calls for elevator service, includes a contact 408 which has one side connected to a source of positive potential, indicated by terminal 410, and its other side is connected to output terminal 411. Contact 408 is closed until the elevator car reaches the distance D, illustrated graphically in FIG. 2, relative to a floor at which the car is to stop. At point D, contact 408 opens to initiate the stopping sequence. The opening of contact 408 is shown graphically at the start of the fixed slowdown distance in FIG. 13, adjacent the heading "Floor Selector Contact 408".

Counter 352 has its outputs connected to the input of ROM 1, and ROM 1 is programmed to provide the desired parabolic stopping pattern shown in FIG. 2. For example, when the counter 352 receives its first pulse at distance D, ROM 1, in response to this binary address will provide a binary signal indicative of the pattern magnitude at point D. The next count of the counter 352 responsive to the next input pulse will cause ROM 1 to output a binary signal indicative of the pattern magnitude at D minus one standard increment of distance. The binary output signals of ROM 1 are applied to the input of the digital to analog converter 356, which is also connected to the source 392 of positive potential via resistor 365, and to ground via resistor 367.

The analog output of digital to analog converter 356 is connected to an output terminal 367. Output terminal 367 is connected to source 394 of positive potential via resistor 368, to ground via resistor 370, to the Q output of flip-flop 398 via resistor 372, and to the inverting input of operational amplifier 358 via resistor 374.

Capacitor 386 is a timing capacitor for the voltage controlled oscillator and is connected from the output of operational amplifier 358 to its inverting input, and analog switch 366 is connected across capacitor 386. The control input for analog switch 366 is connected to the output of analog switch 364. The input 364 is connected to the least significant bit (LSB) of counter 336, and the control input for switch 364 is connected to the Q output of flip-flop 398. The non-inverting input of operational amplifier 358 is connected to ground, and its output is connected to the input of analog switch 362 and to the non-inverting input of operational amplifier 360 via resistor 387. Thus, if switch 366 is open, operational amplifier 358 will provide pulses at a rate dependent upon the magnitude of the analog voltage applied to its inverting input. If switch 366 is closed, operational amplifier 358 will provide a zero output. Operational amplifier 360 is connected to synchronize the pulses provided by operational amplifier 358 with the clock 310. The pulses from clock 310 are applied to the inverting input of operational amplifer 360 via serially connected capacitor 390 and resistor 376. The inverting input is also connected to ground via resistor 378, and to the non-inverting input via capacitor 388.

The non-inverting input of operational amplifier 360 is connected to source 396 of negative potential via resistor 380, to the input of analog switch 362 via resistor 382, and to its output via resistor 384.

The output of operational amplifier 360 is connected to the control input of analog switch 362, to the input of counter 352, and to the input CL of counter 336 via a rectifier diode 385.

The output of analog switch 362 is connected to the inverting input of operational amplifier 358. Output terminal 411 of floor selector 346 is connected to the preset enable input PE of counter 336, to the set input SET of flip-flop 398, and to the reset input R of counter 352 across resistor 362.

Clock 310 synchronizes the VCO pulse generator 350 to the logic zero portion of its output waveform by connecting the clock output to the inverting input of operational amplifier 360 via capacitor 390 and resistor 376. Capacitor 390 and resistor 376 synchronize the VCO pulses to the "fall" of a clock pulse, and capacitor 388 causes the leading edge of the VCO pulse to lag the clock pulse, to enable the same "fall" of the clock pulse to set counter 336 for counting down. The period of the VCO pulse is selected to be less than ½ of the logic zero portion of the clock signal, to insure that the VCO pulse terminates before the associated logic zero portion of the clock signal. FIG. 13 illustrates the VCO pulses, and it also illustrates how the VCO pulse falls within the envelope defined by the logic zero portion of the clock signal.

In the operation of system 300, when the elevator car is to start away from a floor, contact 408 in the floor selector closes to set the motor start/stop memory 398 and provide a logic one at its Q output which causes the gate driver 400 to fire the triac 402 and pick up the motor contactor 404. Thus, the elevator drive motor is started, which starts the car away from the floor. The high Q signal from memory 398 also sets counter 352 to provide zeros at its outputs, and it sets counter 336 to the output 0111 1101, which address is applied to its JAM inputs. The "one" at the LSB position of counter 336 holds the VCO 360 at zero output, as the high Q output of the memory or flip-flop 398 turns analog switch 364 on, and the high LSB of counter 336 is thus applied to the control input of analog switch 366, which turns on switch 366 and shorts the timing capacitor 386 on the operational amplifier 358.

The binary 0111 1101 on the output of counter 336 is below the 1000 0000 neutral address which represents the condition for zero error, as illustrated graphically in FIG. 11. This address thus starts the digital feedback control system with an error that indicates that the rate of the TW pulses is too low, which provides full drive voltage for the brake coil 302 to fully lift the brake and allow the motor to run. Brake release is obtained by an arrangement shown in FIG. 12B, which will be hereinafter described.

When the elevator car reaches the distance D from the floor at which the car is to stop, contact 408 in the floor selector opens, as illustrated in FIG. 13. The opening of contact 408 allows counter 336 to respond to the TW and VCO pulses, it unlocks the motor start/stop memory 398, enabling it to switch its Q output in response to a high signal at its reset input, and it unlocks counter 352, enabling it to count VCO pulses.

The first TW pulse following the arrival of the elevator car at the distance D from the stopping floor advances counter 336 from the preset count of 0111 1101 to the count of 0111 1110. This is shown graphically in FIG. 13 adjacent the heading "Counter 336". The shift of counter 336 from its preset value is also illustrated in FIG. 13, adjacent the heading "Shift of Counter 336".

The change of the LSB of counter 336 from one to zero instantly releases the VCO pulse generator 350, with the inhibit and release of the VCO 350 being illustrated in FIG. 13 adjacent the heading "VCO 350". Since the input to analog switch 364 will now be zero, analog switch 366 will switch to its open state, and the short circuit across capacitor 386 is removed. The speed of the elevator car determines the rate of the TW pulses. The voltage output of the d/a converter 356 determines the rate of the VCO pulses. At count zero of counter 352, ROM 1 produces an output word which causes the d/a converter 356 to output its maximum voltage, and thus the maximum pulse rate. The TW pulse rate and the VCO pulse rate are continuously compared to determine the precise moment when the elevator car reaches the parabolic deceleration pattern shown in FIG. 2. This comparison is accomplished by an electronic race which is started with the receipt of each TW pulse. When the TW pulse advances counter 336 from the preset count to the count of 0111 1110, if the speed of the elevator car is below the maximum speed Vm, the VCO pulse generator, which is released by the "zero" at the LSB location of counter 336, will generate a VCO pulse before the next TW pulse. As illustrated in FIG. 13, this VCO pulse returns the counter 336 to the preset count and the resulting "one" at the LSB location of counter 336 stalls the VCO pulse generator until the next TW pulse is received. The VCO pulse which was generated, however, was counted by counter 352. Thus, the next time a TW pulse is received to start the next race, the magnitude of the voltage provided by the d/a converter 356 will be lower than the voltage applied to the VCO pulse generator 350 for the last race. Thus, each succeeding race becomes more unfavorable to the VCO pulse generator 350 as the count on counter 352 accumulates at the TW rate. When a TW pulse releases the VCO pulse generator 350 and then another TW pulse is received before the VCO pulse generator 350 provides a pulse, the output count of counter 336 will be advanced to 0111 1111. This is also illustrated graphically in FIG. 13. The "one" at the LSB location thus stops the VCO pulse generator 350 from producing a pulse which would erase the LSB "one", and the VCO pulse generator 350 is thus reset to begin its second consecutive losing race with a TW pulse. The next losing race by the VCO pulse generator 350 will not result in inhibiting the VCO pulse generator, as counter 336 is advanced to count 1000 0000. The "one" at the MSB location signals the arrival of the elevator car at the distance $-x'$ in FIG. 2, and this "one" is applied to the reset input of the motor start/stop memory 398, causing the Q output to go to a zero. This change of the Q output from a "one" to a "zero" causes the motor contactor to drop and thus disconnect the elevator drive motor from its source of electrical potential, it prevents analog switch 364 from applying the voltage level appearing at the LSB of counter 336 to the control input of analog switch 366, thus allowing the VCO pulse generator 350 to provide pulses at the desired rate, and thus run counter 352 at the ideal velocity-distance parabolic rate where the VCO pulses become the digital feedback control system reference. FIG. 13 illustrates the change in the output of the flip-flop 398 adjacent the heading "Q-398" and it also illustrates the opening of the analog switch 364 in response to the change in the output of flip-flop 398. Counter 336 will continuously tabulate the results of the succeeding races between the TW and VCO pulses, forcing the TW pulse rate and thus the speed of the elevator car to comply with the VCO pulse rate as the current through the brake coil 302 in FIG. 12B decays and allows the brake to increase the magnitude of the deceleration torque applied to the moving elevator system. While the graph of FIG. 13 illustrates counter 336 immediately reaching an equilibrium adjacent the zero error count of 1000 0000, the inherent lag in drop out of the motor contactor will allow the TW pulses to run the counter 336 up to a count such as 1000 0011. The connection of the Q output of flip-flop 398 to junction 367 via resistor 372 provides some anticipation of the lag in the dropout of the motor contactor. However, only a small amount of anticipation is permissible since the load on the elevator drive motor may be an overhauling one, rather than a hauling load.

In any event, the advancement of counter 336 to a relatively high count away from the zero error due to the motor contactor lag, will be short-lived. ROM 2 is programmed as illustrated graphically in FIG. 11, to provide an anticipatory bang-bang characteristic which will indicate the magnitude of the error. FIG. 12B illustrates anticipatory control 450 and an amplifier and actuator 452 which will respond to the output words of ROM 2 according to the magnitude of error, and the correction rate towards the neutral interface 1000 0000.

ROM 2 includes outputs connected to output terminals 454, 456, 458, 460, 462, 464 and 466. The outputs connected to terminals 454, 456, 458, 460 and 462 are programmed to indicate the magnitude of the error from the neutral interface. The output connected to terminal 464 indicates with a "one" that the brake should be applied, and with a "zero" that the brake should be lifted or released. The output connected to terminal 466 indicates with a "one" that the counter 336 is at the neutral address 1000 0000, and with a "zero" that the counter 336 is not at the neutral address.

FIG. 12B includes a resistive ladder network 470 which includes terminals 454', 456', 458', 460' and 462' connected to the output terminals from ROM 2 having like reference numerals. Resistors 482, 484, 486, 488 and 490 are serially connected from junction 481 to ground, including junction 483 between resistors 482 and 484, junction 485 between resistors 484 and 486, junction 487 between resistors 486 and 488, and junction 489 between resistors 488 and 490. Resistor 472 is connected from terminal 454' to junction 481, resistor 474 is connected from terminal 456' to junction 483, resistor 476 is connected from terminal 458' to junction 485, resistor 478 is connected from terminal 460' to junction 487, and resistor 480 is connected from terminal 462' to junction 489. The output voltage of the ladder network 470 appears at junction 481 and junction 481 is connected to a comparator 500 via a capacitor 502. Comparator 500 may be an operational amplifier 512, with the capacitor 502 being connected to its non-inverting input. The non-inverting input is also connected to the neutral address terminal 466' via resistor 504, to ground via resistor 506, and to the output terminal 516 of the comparator 500 via resistor 514. A reference potential is provided for the inverting input of operational amplifier 512 by connecting a source of positive potential, indicated by terminal 507, to ground via serially connected resistors 508 and 510, and by connecting the inverting input to the junction 511 between resistors 508 and 510.

Normally, the reference voltage at junction 511 exceeds the voltage applied to the non-inverting input of operational amplifier 512 through the capacitor 502, and thus the output of the operational amplifier at terminal 516 is zero. When the rate of change of the ladder voltage due to error correction provides a charge on capacitor 502 which drives the voltage across resistor 506 above the reference potential at junction 511, comparator 500 is triggered to provide a logic one at its output terminal 516. The amplifier and actuator 452 includes the brake coil 302, NPN junction transistors 520, 522, 524, 526, 528 and 530, PNP junction transistor 532, rectifier diodes 534, 536, 538 and 540, resistors 542, 544, 546, 548, 550, 552, 554 and 556, and a capacitor 558. Input terminal 464' is connected to the base electrode of transistors 522 and 526 via resistors 544 and 548, respectively. The output terminal 516 of comparator 500 is connected to the base electrodes of transistors 520 and 528 via resistors 542 and 550, respectively. Diode 534 is connected from ground to the base of transistor 520 via diode 534, with diode 534 being poled to conduct current into the base. Diode 540 is connected from ground to the base of transistor 528, with diode 540 being poled to conduct current into the base. The emitter electrodes of transistors 520, 522, 524, 526, 528 and 534 are all connected to ground.

The collector of transistor 522 is connected to a source of positive potential, indicated by terminal 560, via resistor 546, and the collector of transistor 522 is also connected to the base of transistor 524. The collector of transistor 524 is connected to the source 560 of positive potential via diode 536, which is poled to conduct current towards terminal 560. The collector of transistor 526 is connected to source 560 via resistor 552. The collector of transistor 528 and the base of transistor 530 are also connected to the collector of transistor 526. The collector of transistor 530 is connected to source 560 via serially connected resistors 554 and 556, and the junction 562 between resistors 554 and 556 is connected to the base of transistor 532. The emitter of transistor 532 is connected to source 560, and its collector is connected to ground via diode 538, which is poled to conduct current into the collector. Brake coil 302 is connected between the collectors of transistors 524 and 532. Capacitor 558 is connected from source 560 to ground.

When comparator 500 is not triggered and is providing a logic zero, the amplifier and actuator operate in a bang-bang mode without modification by the anticipatory control, i.e., the amplifier and actuator 452 is under control of terminal 464'. The zero ouput of comparator 500 turns transistors 520 and 528 off, and a zero input at terminal 464' turns transistors 522 and 526 off. This turns transistors 524, 530 and 532 on and full positive to negative drive is applied to the brake coil 302 from terminal 560, transistors 532, brake coil 302 and transistor 524. This full brake current causes the brake to lift. If terminal 464' is switched to a "one" by ROM 2, transistor 522 turns on, transistor 524 turns off, transistors 526 and 530 turn on, and transistor 532 turns off. The brake current is rapidly forced to zero by the full minus to plus potential of the power supply, starting from ground, through diode 538, the brake coil 302, and through diode 536.

If comparator 500 is triggered by a too rapid error correction towards the neutral interface, the "one" at terminal 516 turns transistors 520 and 528 on, which turns transistors 522, 530 and 532 off, and transistor 524 on, regardless of the signal at input terminal 562'. Thus, in this "hang" mode, the brake current may decay more slowly through the circuit which includes diode 538, brake coil 302 and transistor 524. When the neutral address terminal 466 is a "one", indicating there is zero error, the "one" maintains the comparator 500 in its triggered position.

Figure 14:
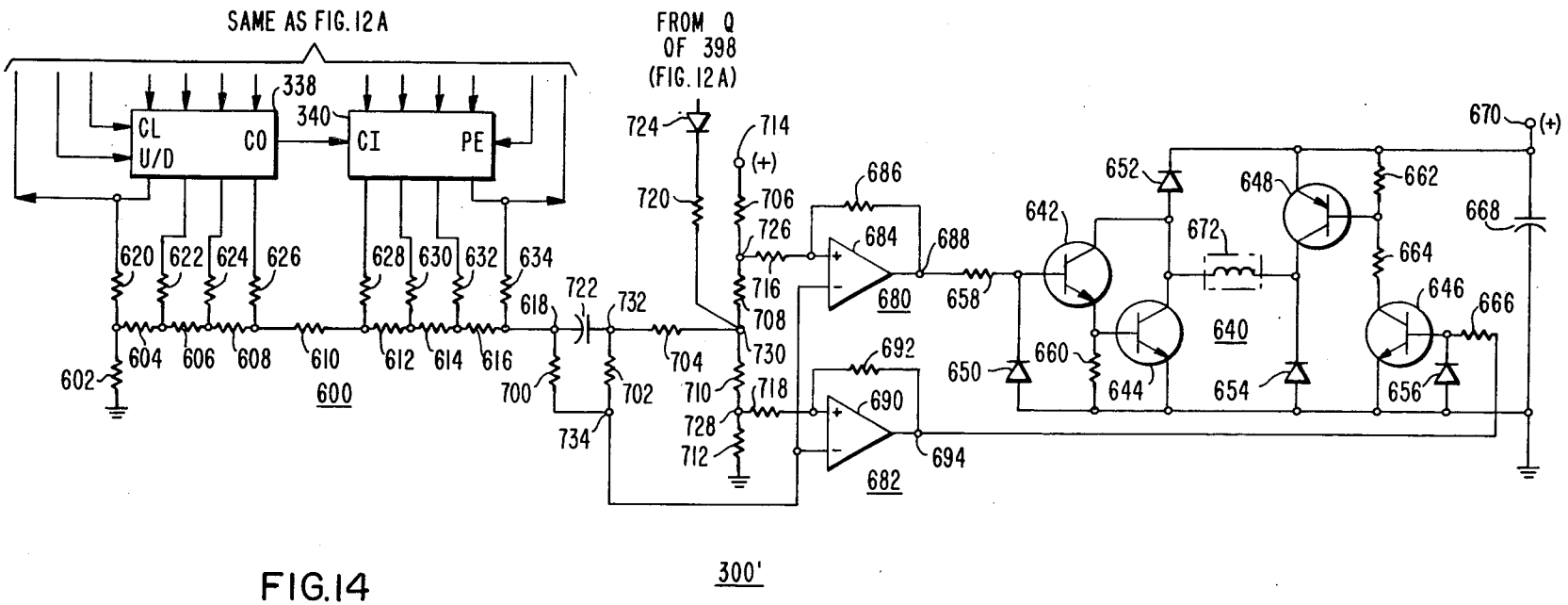
FIG. 14 is a schematic diagram which illustrates a modification of the elevator system shown in FIGS. 12A and 12B, which modification provides the aniticipatory feature without requiring the use of a programmable read-only memory.

FIG. 14 is a schematic diagram which illustrates how the system 300 of FIGS. 12A and 12B may be modified to eliminate the need for ROM 2. The system of FIG. 14 will be referenced 300', to indicate that it is a modification of system 300. Like reference numerals in FIGS. 12A, 12B and 14 indicate like components and they will not be described in detail.

More specifically, the digital feedback and control system 300' includes a resistive R-2R ladder network 600 which is connected directly to the outputs of counters 338 and 340. Resistors 602, 604, 606, 608, 610, 612, 614 and 616, which have a value of R, are serially connected from ground to an output terminal 618, and resistors 620, 622, 624, 626, 628, 630, 632 and 634, which have a value of 2R, are connected from the outputs of counters 338 and 340 to junctions between the serially connected resistors.

System 300' includes an amplifier and actuator 640 which includes NPN junction transistors 642, 644 and 646, PNP junction transistor 648, diode rectifiers 650, 652, 654 and 656, resistors 658, 660, 662, 664 and 666, a capacitor 668, a source of positive potential indicated by terminal 670, and a brake coil 672. The collectors of transistors 642 and 644 are connected in common and the common connection is connected to the source 670 via the diode 652 which is poled to conduct current towards source 670. The emitter of transistor 642 is connected to the base of transistor 644 and also to ground via resistor 660. The emitter of transistor 644 is connected to ground. Diode 650 is connected from ground to the base of transistor 642, with diode 650 being poled to conduct current toward the base of transistor 642. The collector of transistor 646 is connected to source 670 via serially connected resistors 664 and 662, and the junction between resistors 644 and 662 is connected to the base of transistor 648. The emitter of transistor 646 is connected to ground. The base of transistor 646 is connected to ground through diode 656, with diode 656 being poled to conduct current toward the base. The emitter of transistor 648 is connected to source 670, and the collector of transistor 648 is connected to ground through diode 654, with diode 654 being connected to conduct current toward the collector. The brake coil 672 is connected between the collectors of transistors 644 and 648. Capacitor 668 is connected from source 670 to ground. One end of each of the resistors 658 and 666 is connected to the base of transistors 642 and 646, respectively.

Transistors 642 and 644 are controlled by a first comparator 680, and transistors 646 and 648 are controlled by a second comparator 682. The first comparator 680 includes an operational amplifier 684 having a feedback resistor 686 connected from its output 688 to its non-inverting input, and the second comparator 682 includes an operational amplifier 690 having a feedback resistor 692 connected from its output 694 to its non-inverting input. The output 688 of the first comparator 680 is connected to the base of transistor 642 via resistor 658, and the output 694 of the second comparator 682 is connected to the base of transistor 646 via resistor 666.

The circuit between the output 618 of the resistive ladder network 600 and the inputs to the comparators 680 and 682 includes resistors 700, 702, 704, 706, 708, 710, 712, 716, 718 and 720, a capacitor 722, and a rectifier diode 724. Resistors 706, 708, 710 and 712 are serially connected from a positive source of potential, indicated by terminal 714, to ground. The non-inverting input of operational amplifier 680 is connected to junction 726 between resistors 706 and 708 via resistor 716, and the noninverting input of operational amplifier 690 is connected to the junction 728 between resistors 710 and 712. The output terminal 618 of ladder network 600 is connected to junction 730 between resistors 708 and 710 via serially connected capacitor 722 and resistor 704. Resistor 700 has one end connected to terminal 618 and resistor 702 has one end connected to the junction 732 between capacitor 618 and resistor 704. The remaining ends of resistors 700 and 702 are connected in common at junction 734, and junction 734 is connected to the inverting inputs of operational amplifiers 684 and 690. Diode 724 and resistor 720 are connected from the Q output of flip-flop 398, shown in FIG. 12A, to junction 730, with diode 724 being poled to conduct current toward junction 730.

In the operation of the system 300' shown in FIG. 14, when the motor start/stop memory or flip-flop 398 indicates with a high Q output that the traction drive motor of the elevator system should be energized, this high signal at junction 730 causes both comparators 680 and 682 to provide a positive output which turns on all of the transistors and energizes the brake coil 672 via transistors 648 and 644 to fully lift the brake. The Q signal goes to zero when the car arrives at the proper point on the deceleration parabola shown in FIG. 2. The TW pulse rate quickly provides an error count on the counters 338 and 340 to drive junction 618 above junction 730, with the plate of capacitor 722 connected to junction 732 being negative relative to its other plate, which turns off the transistors and drives the brake current rapidly towards zero with full minus to plus potential, via diodes 652 and 654. This applies the brake and reduces the voltage which appears between junctions 618 and 730. If this voltage reduction is gradual, anticipation is not required. If this voltage reduction is rapid, anticipation is required to prevent overshoot. Anticipation to "hang" is provided by the residual charge on capacitor 722 to cause the voltage at junction 734 to precede or anticipate the return to zero error, causing comparator 680 to switch "high" prematurely even while some positive "error" from junction 618 to junction 730 still exists. When the comparators are in opposite states, a stable "hang" condition is achieved which reduces the current decay rate in the brake coil 672. The offset resistors 708 and 710 in the reference voltage divider make this "hang" mode a controlled state either by nearly zero error between junctions 618 and 730, or by anticipatory signal addition from resistor 702 that balances the transitory junction 618 to junction 730 error transmitted by resistors 700.

We claim as our invention:

1. An elevator system, comprising:

an elevator car to be stopped at a predetermined stopping point, first means providing a first train of pulses responsive to the movement of the elevator car, with each pulse indicating a predetermined increment of car movement, second means providing a second train of pulses responsive to the desired movement of the elevator car from increment to increment up to the stopping point, counter means responsive to said first and second trains of pulses such that its output count indicates which pulse train has produced the greater number of pulses, and the precise number of the difference, to provide both a qualitative and a quantitative indication of error, respectively, and control means for controlling the deceleration of the elevator car in response to the count on said counter means, with the control means selecting one of at least first and second deceleration efforts, with the first deceleration effort being selected when the count indicates the number of pulses in the first pulse train exceeds those in the second pulse train, and with said second deceleration effort being selected when the count indicates the number of pulses in the second pulse train exceeds those in the first pulse train.

2. The elevator system of claim 1 wherein the control means includes a third deceleration effort, and including anticipatory means responsive to the rate at which the quantitative error count is corrected, said anticipatory means providing a predetermined signal when the rate of error correction exceeds a predetermined magnitude, said control means selecting the thrid deceleration effort in response to said predetermined signal being provided by said anticipatory means.

3. The elevator system of claim 2 wherein the anticipatory means includes a comparator having first and second output states, said comparator providing the first output state when the rate at which the quantitative error is corrected is below a predetermined magnitude, and providing the second output state when the rate is above the predetermined magnitude, said second output rate being the predetermined signal to which the control means is responsive to select the third deceleration effort.

4. The elevator system of claim 2 wherein the control means includes means for presetting the counter means to a predetermined count, and memory means responsive to the output count of said counter means for providing binary output words for the anticipatory means which indicate the magnitude of the quantitative count error relative to the preset count.

5. The elevator system of claim 4 wherein the anticipatory means includes a controllable impedance network, with its impedance being responsive to the binary output word provided by the memory means, energy storage means responsive to the impedance of said controllable impedance network, and comparator means responsive to the electrical charge on said energy storage means, said comparator means providing the predetermined output of the anticipatory means when the electrical charge on the energy storage means exceeds a predetermined magnitude.

6. The elevator system of claim 1 wherein the control means includes first and second switching means, a control element, and a source of unidirectional potential, said first and second switching means connecting opposite sides of said control element to said source of electrical potential, with the first deceleration effort being provided when said first and second switching devices are both switched to a current conducting condition, and with the second deceleration effort being provided when both said first and second switching devices are switched to a current blocking condition.

7. The elevator system of claim 6 including circuit means which effectively reverses the polarity of the source of unidirectional potential across the control element, while preventing current flow in the reverse direction through the control element, when both the first and second switching devices are switched to their current blocking conditions, to force the current flowing through the control element rapidly to zero.

8. The elevator system of claim 6 wherein the control means includes a third selectable deceleration effort intermediate the first and second deceleration efforts, with said third deceleration effort being provided by switching one of the switching devices to its current blocking condition while allowing the other switching device to remain in its current conductive condition, and including circuit means which functions to provide a commutation path for the control element to dissipate stored energy at a more gradual rate than when both switching devices are switched to their current blocking conditions.

9. The elevator system of claim 8 including anticipatory means for controlling the rate at which the quantitative error is corrected, with the anticipatory means forcing the control means into the third deceleration effort notwithstanding a qualitative error on the counter means which indicates the control means should provide the first or second deceleration effort.

10. The elevator system of claim 8 including anticipatory means which allows the count on the counter means to select one of the first and second deceleration efforts of the control means when the rate at which the quantitative error is corrected is below a predetermined magnitude, and which overrides the normal selection of the control means to initiate the third deceleration effort when the correction rate exceeds the predetermined magnitude.

11. The elevator system of claim 10 wherein the anticipatory means includes memory means responsive to the magnitude of the quantitative error above and below zero error.

12. The elevator system of claim 10 wherein the anticipatory means is responsive to a change in the output count of the counter means from one side of zero error to the other, terminating its override of the control means upon this occurrence.

* * * * *